US006042019A

United States Patent [19]

Rusch

[11] Patent Number: 6,042,019

[45] Date of Patent: Mar. 28, 2000

[54] THERMAL SPRAY GUN WITH INNER PASSAGE LINER AND COMPONENT FOR SUCH GUN

[75] Inventor: William P. Rusch, Ronkonkoma, N.Y.

[73] Assignee: Sulzer Metco (US) Inc., Westbury, N.Y.

[21] Appl. No.: 08/650,082

[22] Filed: May 17, 1996

[51] Int. Cl.[7] ..... B05C 5/04; B05B 1/24

[52] U.S. Cl. ..... 239/85; 239/132.3

[58] Field of Search ..... 239/85, 79, 83, 239/84, 132.1, 132.3, 128, 13, DIG. 19

[56] References Cited

U.S. PATENT DOCUMENTS

| | | | |
|---|---|---|---|
| 3,055,591 | 9/1962 | Shepard | 239/13 |
| 3,112,072 | 11/1963 | Malone | 239/79 |
| 3,986,668 | 10/1976 | Huhne et al. | 239/85 |
| 4,231,518 | 11/1980 | Zverev et al. | 239/85 X |
| 4,338,099 | 7/1982 | Crouch et al. | 48/197 R |
| 4,416,421 | 11/1983 | Browning | 239/79 |
| 4,644,878 | 2/1987 | Nod et al. | 239/405 |
| 4,869,936 | 9/1989 | Moskowitz et al. | 239/79 X |
| 5,148,986 | 9/1992 | Rusch | 239/85 |
| 5,165,705 | 11/1992 | Huhne | 239/79 |
| 5,234,164 | 8/1993 | Huhne | 239/79 |
| 5,405,085 | 4/1995 | White | 239/13 |
| 5,520,334 | 5/1996 | White | 239/85 |

FOREIGN PATENT DOCUMENTS 63-315152 12/1988 Japan .

*Primary Examiner*—Kevin Weldon
*Attorney, Agent, or Firm*—H. S. Ingham

[57] ABSTRACT

A gas cap for a thermal spray gun has a spray passage extending from the combustion chamber to an exit end, and a thermal spray material is fed into the passage. A nozzle component of the gas cap is formed of a tubular inner member in thermal contact with a metallic outer member, such as copper, that is in contact with a fluid coolant. The inner member is formed of a hard, thermally conductive material, preferably a carbide in a metal matrix, such as tungsten carbide in cobalt.

17 Claims, 1 Drawing Sheet

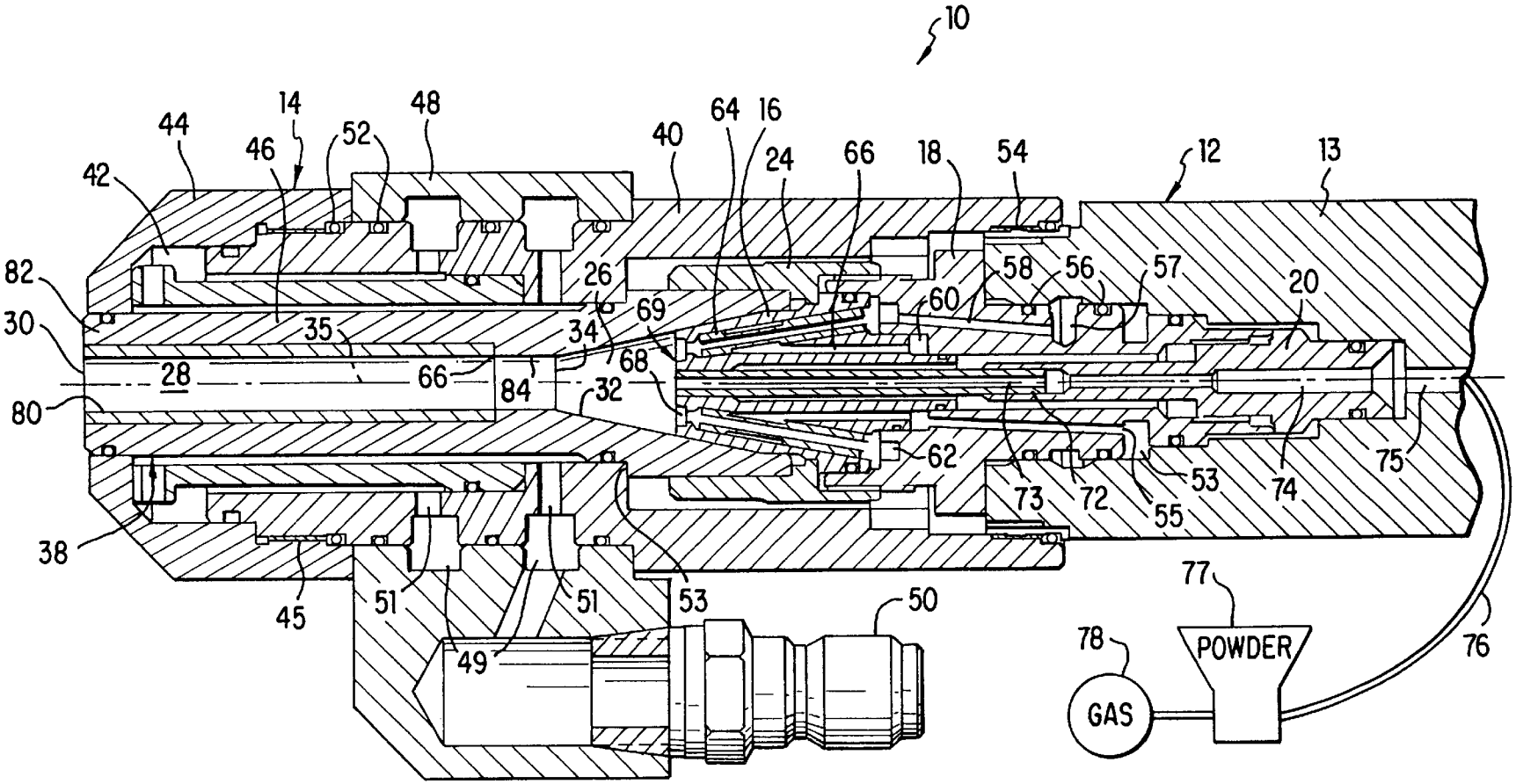
POWDER
GAS

THERMAL SPRAY GUN WITH INNER PASSAGE LINER AND COMPONENT FOR SUCH GUN

This invention relates to thermal spray guns, and particularly to the passage for the spray stream in such a gun.

BACKGROUND

Thermal spraying, also known as flame spraying, involves the heat softening of a heat fusible material such as metal or ceramic, and propelling the softened material in particulate form against a surface which is to be coated. The heated particles strike the surface where they are quenched and bonded thereto. In one type of thermal spray gun, the heat fusible material is supplied to the gun in powder form. Such powders are typically comprised of small particles, e.g., between 100 mesh U.S. Standard screen size (149 microns) and about 2 microns. The carrier gas, which entrains and transports the powder, can be one of the combustion gases or an inert gas such as nitrogen, or it can be simply compressed air. Other thermal spray guns utilize wire as a source of spray material.

Especially high quality coatings of thermal spray materials may be produced by spray guns using oxygen and fuel at very high velocity (HVOF guns). This type of gun has an internal combustion chamber with a high pressure combustion effluent directed into the constricted throat of a short or long gas cap (also sometimes termed nozzle). Powder is fed axially or radially into the combustion chamber or gas cap to be heated and propelled by the combustion effluent to a workpiece being coated.

Examples of HVOF guns are disclosed in U.S. Pat. Nos. 4,417,421 (Browning) and 5,148,986 (Rusch). Generally the powder (or wire) spray material in HVOF guns is introduced internally into a spray passage where there can be a tendency to deposit on the passage walls with resulting buildup. The buildup can dislodge to pass lumps onto the coating, or close down the passage to result in backpressure and attendant malfunction of the gun. U.S. Pat. No. 5,165,705 (Huhne) addresses such deposit by the application of a surface film in the combustion chamber. Reflective surface films have been taught for a different purpose, vis. enhancement of heating, in U.S. Pat. No. 3,055,591 (Shepard). A ceramic flow nozzle is taught in U.S. Pat. No. 5,405,085 (White), wherein the ceramic nozzle absorbs heat from a first portion of flow stream, and transfers the heat to a second portion of the flow stream downstream.

An object of the invention is to provide an improved thermal spray gun, particularly an HVOF gun, having a reduced tendency for buildup in the spray stream passage in the gun. Another object is to provide a novel component for such a gun, such component providing for a reduced tendency for buildup in the spray stream passage in the gun.

BRIEF DESCRIPTION OF THE DRAWING

The drawing illustrates a longitudinal section of a portion of a thermal spray gun incorporating the invention.

SUMMARY

The foregoing and other objects are achieved, at least in part, in a thermal spray gun that includes a combustion chamber, gas means for injecting a fuel gas and a combustion-support gas into the combustion chamber, a gas cap with a passage extending from the combustion chamber to an exit end, and feeding means for feeding a thermal spray material into the passage. The gas cap comprises a tubular inner member forming at least a substantial portion of the passage, and cooling means for cooling the inner member. Preferably the cooling means comprises liquid means for flowing liquid coolant in the gas cap in thermal communication with the inner member. The inner member is formed of a thermally conductive material with a hardness of at least Rc65, preferably a carbide in a metal matrix, such as tungsten carbide in a cobalt matrix. With combustion of the fuel gas in the combustion chamber, a spray stream containing the thermal spray material in finely divided form is propelled through the exit end without substantial buildup of thermal spray material in the passage.

In a preferred aspect, the gas cap further comprises a nozzle component formed of the inner member and a metallic outer member. The inner member is affixed within the outer member in thermal contact therewith, and the outer member is in direct contact with the flowing fluid coolant. Copper or copper alloy is particularly suitable for the outer member.

Objects are also achieved by a nozzle component for such a gun. The component comprises an inner member formed of a thermally conductive material with a hardness of at least Rc65, preferably a carbide with a metal matrix. The nozzle component has a central passage therethrough with the inner member forming at least a substantial portion of the central passage of the gas cap of the gun. The nozzle component is configured for insertion as a component of the gas cap for the passage to extend from the combustion chamber to an exit end so as to pass the spray stream therethrough, such that the inner member is in thermal communication with the liquid coolant.

DETAILED DESCRIPTION

One type of thermal spray gun incorporating the invention is similar to that described in the aforementioned U.S. Pat. No. 5,148,986. The gun is modified as set forth herein. With reference to the drawing, a thermal spray gun 10 includes a cylindrical gas body 12 with a gas cap 14 mounted thereon. Fuel gas from a pressurized fuel source is obtained through a conventional valve portion of the gun (not shown), and a combustion support gas is obtained from a pressurized source such as compressed air or preferably oxygen. Additional air, such as for an annular flow in the gas cap, is optional but not necessary in the present embodiment.

The gas body 12 includes a support member 13. The nozzle member 16, an intermediate member 18 and a rear member 20 held together coaxially in the member 13 with a nozzle nut 24. The nozzle member extends into the gas cap 14 which, together with the nozzle member forms a combustion chamber 26. The gas cap has a central passage 28 extending from the chamber to an exit end 30. Advantageously with the present invention, the gas cap and its passage are elongated, so that the passage generally has a ratio of length to minimum diameter of between about 5 and 25. Rearward of the passage, a forwardly converging portion 32 proximate the nozzle 16 extends to a constriction 34 to thereby form the combustion chamber. The forward convergence 32 of the gas cap from the nozzle is at an angle preferably between about 5° and 15°, e.g. 12° with the central axis 35 of the gun. The elongation of the gas cap passage 28 provides for an extended heating and accelerating zone for a thermal spray powder. (As used herein and in the claims, "forward" or "forwardly" denotes toward the exit end of the gun; and "rear", "rearward" or "rearwardly" denotes the opposite. Also "inner" denotes toward the axis, and "outer" denotes away from the axis.)

The gas cap 14 is an assembly that includes a tubular nozzle component 38 retained within a cylindrical outer body 40 with channelling 42 therebetween for water or other fluid, preferably liquid, for cooling. A forward retainer 44 with threading 45 holds a cylindrical baffle 46 in the outer body to effect directed channeling. A fluid transfer block 48 surrounds part of the outer body. This block has a fluid inlet 50 and outlet (not shown), and a connecting pair of annular channels 49 formed cooperatively with the outer body which also has a connecting pair of radial ducts 51 therein, all connected for supporting flow-through of the water in the channelling. Appropriate O-rings 52 seal the channeling. The outer body is attached to the gas body 12 with threading 54 and retains the component 38 by a shoulder 53 thereon.

The intermediate member 18 is retained in a corresponding bore in the support member 13. The intermediate member and associated components are fitted with a plurality of O-rings 56 to maintain gas-tight seals. The member 18 has therein a first annular groove 53 associated with at least one (e.g. 8) arcuately spaced longitudinal passages 55 (one shown) directed forwardly therefrom. The intermediate member 18 also has a second annular groove 57 forward of the first groove 53. At least one (e.g. 8) further arcuately spaced longitudinal passages 58 (one shown) are directed forwardly from the second groove, spaced arcuately with and outwardly from the first passages 55. The two sets of passages 55, 58 lead to respective annular spaces 60, 62 in the rear section of the nozzle member 16.

A plurality of arcuately spaced tubes 64 (e.g. 8 tubes) are press fitted into the nozzle member 16 so as to converge forwardly from the one annular space 62. A similar plurality of drilled holes 66 from the other space 60 are alternated arcuately with the tubes. The tubes convey fuel, and the holes convey oxygen to an annular mixing region 68 near the face 69 of the nozzle. The fuel mixture is injected from this region into the chamber 26 where combustion takes place, effecting a high pressure, high velocity flow of combustion product through the central passage 28.

The foregoing example illustrates one means for introducing the fuel and oxygen into the chamber. The actual means is not critical to this invention and may be conventional or otherwise desired. For example, the gas channels may be formed as a pair of concentric annular gas passages. In other embodiment, the fuel and oxygen gases may be mixed further back in the gas body in a siphon plug or the like. Alternatively, each gas may be introduced directly into the chamber without initial mixing.

A tube 72 with a central channel 73 for a thermal spray powder extends from the rear member 20 into and through the nozzle 16 to the combustion chamber. The central channel is fitted into an axial channel 74 in the rear member 20 which in turn connects with a further channel 75 in the support member 13. The latter channel, in turn, communicates with a hose 76 from a powder feeder 77 (by way of conventional gun fittings). Powder from the feeder is entrained in a carrier gas from a pressurized gas source 78 such as compressed air or nitrogen. The powder feeder is a conventional or desired type but must be capable of delivering the carrier gas at high enough pressure to deliver powder through the powder channels into the combustion chamber 26.

Supplies of the gases to the combustion chamber should be provided at a high pressure, preferably at least five atmospheres of pressure, for high velocity operation. The combustible mixture is ignited in the chamber conventionally such as with a spark device, so that the mixture of combusted gases will issue from the exit end as a sonic or supersonic flow entraining the powder. The heat of the combustion will heat soften or melt the powder material, or at least propel it at sufficient velocity, to deposit a coating onto a substrate.

According to the present invention, the nozzle component 38 of the gas cap 14 includes an inner member 80 formed of a thermally conductive material having a hardness of at least Rc65. Preferably this material is a carbide in a metal matrix so as to provide both high hardness and thermal conductivity. The carbide itself is preferably tungsten carbide, chromium carbide, boron carbide, titanium carbide or silicon carbide. The matrix metal should be at least 3% by weight of the total of the carbide and the matrix, and preferably is a heat resistant metal, advantageously nickel or cobalt neat or as an alloy thereof, for example with 20% by weight chromium in the nickel, such alloying being to improve heat resistance or other properties. Tungsten carbide bonded with a cobalt matrix is particularly suitable. The tungsten carbide may be sintered or cast tool grade carbide containing cobalt in a range of about 3% to 20% by weight, for example 6% cobalt. Other suitable carbides and matrix metals for the purpose are tungsten carbide in a nickel matrix, chromium carbide in a nickel chromium alloy matrix, boron carbide in a nickel matrix, titanium carbide in a nickel matrix, and silicon carbide in a nickel matrix.

The term "thermally conductive" is intended to mean reasonably conductive, not necessarily as good as some metals, but distinguished from thermally insulating. The ultimate function of the liner being thermally conductive is to remove heat away from the liner sufficiently well for it to remain relatively cool, preferably less than 260° C. (500° F.).

In a preferred embodiment the nozzle component 38 further includes a metallic, tubular outer member 82. The inner member 80, of a hard, thermally conductive material as set forth above, is affixed as a liner within the outer member in thermal contact therewith. The outside surface of the outer member is in direct contact with the flowing water or other fluid coolant in the channelling 42. The liner 80 is in the form of an insert of carbide or the like, at least 0.75 mm thick and generally up to about 8 mm, e.g. 1.6 mm thick. The liner is press fitted, brazed or the like, into the outer member. Alternatively, the outer member may be cast onto the liner. The liner 80 should be in intimate contact with the outer member 82 for thermal conduction of heat generated by the combustion and carried by the spray stream through the passage. The outer member should be a good thermal conductor, preferably being copper, brass or other high copper alloy. In the present configuration, the rear end 32 of the outer member forms an initial converging portion of the passage to delimit the combustion chamber. A straight portion 84 of passage in the outer member extends from the chamber before the carbide insert forms the remaining portion of the passage. The insert should extend the passage smoothly without creating a significant edge to disrupt flow. The liner, although not necessarily extending the full length of the passage, should be located at least where there is a tendency for any buildup of spray material, and may extend back into the combustion chamber.

The present arrangement allows a nozzle component 38 comprising an inner member in accordance with the invention to replace a worn or otherwise deteriorated component in a thermal spray gun. Such a component also may substitute for a prior component in a thermal spray gun such as a type shown in the aforementioned U.S. Pat. No. 5,148,986.

Other configurations may be used. For example, the passage 28 may expand toward the outer end to enhance development of supersonic flow, as shown in the aforementioned U.S. Pat. No. 4,416,421, incorporated herein by reference. In another example, the inner member 80 may constitute the nozzle component in the form of a self supporting member in direct contact with the cooling fluid, without an outer member. Although particularly directed to an elongated gas cap and passage, an inner member with cooling thereof may be utilized in a shorter gas cap, for example of the type disclosed in the aforementioned U.S. Pat. No. 5,148,986 with respect to FIG. 4 thereof. A short gas cap may be formed substantially only of an outer member and an inner member, wherein the outer surface exposure to air constitutes a cooling means to provide sufficient cooling. In another embodiment the liquid cooling may be replaced with a plurality of fins extending outwardly from an outer member into the ambient air, or into a flow of cooling or shroud air used with the spray process, so as to allow air cooling.

The spray material generally is introduced in any conventional or desired manner compatible with the invention. Powder may be fed axially, as shown or with the tube 73 extending farther into the chamber 26 or into the passage 28. Alternatively, the powder may be injected through a ring of orifices (not shown) proximate the axis 35 of the gun. In another alternative, the spray material may be fed radially into the passage in the conventional manner. Although the invention has been described for a powder thermal spray material, it may be utilized with a gun that sprays from a wire form of the material, particulaly using a short form of air cap.

In the present example the inner end of the gas cap forms the combustion chamber cooperatively with the face of the nozzle that injects the combustion gases. In other cases the invention may be associated with a combustion chamber that is in a gun body separate from the gas cap, as in the type of gun taught in the aforementioned U.S. Pat. No. 4,416,421. In that case the passage for the spray stream includes an orthogonal portion connecting into the combustion chamber, and the hard inner member would be in the portion of the nozzle after the orthogonal portion.

It has been found that thermal spray gun with an elongated gas cap according to the invention can be operated for an extended period of time spraying aluminum oxide, nickel alloy with 25% chromium, nickel-chromium-boron-silicon self-fluxing alloy and chromium carbide in nickel-chromium alloy binder. Such spraying has been effected without substantial buildup of thermal spray material in the passage. This demonstrated a significant improvement over similar guns without such a liner, and over such guns with a chrome plate coating in the central passage.

While the invention has been described above in detail with reference to specific embodiments, various changes and modifications which fall within the spirit of the invention and scope of the appended claims will become apparent to those skilled in this art. Therefore, the invention is intended only to be limited by the appended claims or their equivalents.

What is claimed is:

1. A thermal spray gun comprising chamber means defining a combustion chamber, gas means for injecting a fuel gas and a combustion-support gas into the combustion chamber, a gas cap with a passage extending from the combustion chamber to an exit end, and feeding means for feeding a thermal spray material into the passage, wherein the gas cap comprises a nozzle component comprising a metallic outer member and a tubular inner member affixed within the outer member in thermal contact therewith, the inner member forming at least a substantial portion of the passage, and further comprises cooling means for flowing liquid coolant in the gas cap in thermal communication with the inner member to cool the inner member, the outer member being in direct contact with the flowing liquid coolant, and the inner member being formed of a thermally conductive material with a hardness of at least Rc65, such that, with combustion of the fuel gas in the combustion chamber, a spray stream containing the thermal spray material in finely divided form is propelled through the exit end without substantial buildup of thermal spray material in the passage.

2. The thermal spray gun of claim 1 wherein the inner member is formed of a carbide with a metal matrix.

3. The thermal spray gun of claim 2 wherein the carbide is selected from the group consisting of tungsten carbide, chromium carbide, boron carbide, titanium carbide and silicon carbide, and the metal of the matrix is nickel, cobalt or an alloy thereof.

4. The thermal spray gun of claim 3 wherein the outer member is formed of copper or copper alloy.

5. The thermal spray gun of claim 1 wherein the outer member is formed of copper or copper alloy.

6. The thermal spray gun of claim 3 wherein the carbide is selected from the group consisting of tungsten carbide in a cobalt matrix, tungsten carbide in a nickel matrix, chromium carbide in a nickel chromium alloy matrix, boron carbide in a nickel matrix, titanium carbide in a nickel matrix, and silicon carbide in a nickel matrix.

7. The thermal spray gun of claim 6 wherein the carbide is tungsten carbide in a cobalt matrix.

8. The thermal spray gun of claim 1 wherein the passage is elongated.

9. The thermal spray gun of claim 8 wherein the passage has a substantially constant diameter.

10. The thermal spray gun of claim 8 wherein the passage is expanded toward the exit end.

11. A nozzle component for a thermal spray gun, the gun having a combustion chamber therein, gas means for injecting a fuel gas and a combustion-support gas into the combustion chamber for combustion, feeding means for feeding a thermal spray material to effect a spray stream in combination with the combustion, and a gas cap extending from the combustion chamber and including cooling means for flowing liquid coolant in the gas cap, wherein the nozzle component comprises a metallic outer member and an inner member affixed within the outer member in thermal contact therewith, the inner member being formed of a thermally conductive material with a hardness of at least Rc65, the nozzle component having a central passage therethrough with the inner member forming at least a substantial portion of the passage, the nozzle component being configured for insertion into the gas cap for the passage to extend from the combustion chamber to an exit end so as to pass the spray stream therethrough, and further configured for the inner member to be in thermal communication with the liquid coolant with the outer member in direct contact with the flowing liquid coolant in the gas cap.

12. The component of claim 11 wherein the outer member is formed of copper or copper alloy.

13. The component of claim 11 wherein the inner member is formed of a carbide with a metal matrix.

14. The component of claim 13 wherein the carbide is selected from the group consisting of tungsten carbide, chromium carbide, boron carbide, titanium carbide and silicon carbide, and the metal of the matrix is nickel, cobalt or an alloy thereof.

15. The component of claim 14 wherein the carbide is selected from the group consisting of tungsten carbide in a cobalt matrix, tungsten carbide in a nickel matrix, chromium carbide in a nickel chromium alloy matrix, boron carbide in a nickel matrix, titanium carbide in a nickel matrix, and silicon carbide in a nickel matrix.

16. The component of claim 15 wherein the carbide is tungsten carbide with a cobalt matrix.

17. The component of claim 16 wherein the outer member is formed of copper or copper alloy.

* * * * *